US006599204B2

(12) United States Patent
Kasashima et al.

(10) Patent No.: US 6,599,204 B2
(45) Date of Patent: Jul. 29, 2003

(54) GOLF BALL

(75) Inventors: Atsuki Kasashima, Saitama (JP); Hiroto Sasaki, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/820,869

(22) Filed: Mar. 30, 2001

(65) Prior Publication Data

US 2001/0036872 A1 Nov. 1, 2001

(30) Foreign Application Priority Data

Mar. 31, 2000 (JP) ..... P.2000-097701

(51) Int. Cl.[7] ..... A63B 37/12
(52) U.S. Cl. ..... 473/383
(58) Field of Search ..... 473/378–384, 473/377

(56) References Cited

U.S. PATENT DOCUMENTS 4,681,323 A * 7/1987 Alaki et al. ..... 473/378
4,720,111 A * 1/1988 Yamada ..... 473/382
4,840,381 A 6/1989 Ihara et al. ..... 273/232
4,974,852 A * 12/1990 Hiraoka et al. ..... 473/372
5,078,402 A * 1/1992 Oka ..... 473/380
5,470,076 A * 11/1995 Cadorniga ..... 473/378
5,601,503 A * 2/1997 Yamagishi et al. ..... 473/384
5,695,413 A * 12/1997 Yamagishi et al. ..... 473/374

* cited by examiner

*Primary Examiner*—Mark S. Graham
*Assistant Examiner*—Raeann Gordon
(74) *Attorney, Agent, or Firm*—Sughrue Mion, PLLC

(57) ABSTRACT

A golf ball having a plurality of dimples on a spherical surface thereof, the dimples each having a circular shape in a plan view, is provided, wherein a virtual dimple is supposed to have a circular shape having the same diameter as the circular shape of the dimple in the plan view, and to be a part of a circle having the same sectional area as that of the dimple in the sectional view;

at least 80% of the dimples have depths not less than 104% of the depth of the virtual dimple, and have a non-circular-arc-shape in a sectional view; and a total volume of the dimple is in a range of from 300 to 550 $mm^3$.

5 Claims, 3 Drawing Sheets

GOLF BALL

BACKGROUND OF THE INVENTION

1. Field of the Invention

The present invention relates to a golf ball, and more particularly to an improvement of a practice golf ball repeatedly used for a long period of time.

2. Description of the Related Art

As is widely known, a golf ball normally has a large number of dimples that are each circular when viewed frontally and are arranged densely for a purpose of improving flight performance of the ball.

A sectional shape of the dimples, especially a practice golf ball, will be described with reference to FIGS. 4 and 5.

FIGS. 4 and 5 are sectional views golf balls in which a radially extended line passes through the center of the dimple.

The contours of the dimple shown in FIG. 4 are such that a wall surface 5 of the dimple 2 is formed in accordance with a circular arc 11 that is a part of a circle 10 with a radius of r centered on a position indicated by reference character C. Accordingly, in FIG. 4, the diameter d of the dimple corresponds to the length of a chord that joins two edges or two points 4, 4 of the dimple 2 at each of which the circular arc 11 and an undimpled portion 3 are divided. A depth f of the dimple is equal to a circular-arc depth g that is downwardly extended from the center of the chord to the circular arc 11 (i.e., bottom 6).

A dimple 2 shown as another example in FIG. 5 is of a pan bottom type in which a wall surface 5 steeply extends from an edge 4, while deviating from a circular arc of a circle 10, to a relatively flat bottom 6. The depth f of the dimple 2 in this case is smaller than the circular-arc depth g.

Since a practice golf ball is used repeatedly for a long period of time, its surface gradually wears down, and thus the dimples become shallow. Accordingly, when the ball continues to be subjected to wear, a decrease in the dimple function, such as a steep rise in trajectory and a reduction in flight distance, appears remarkably.

The present invention was made in consideration of this problem, and aims to provide a golf ball that is not easily worn down in spite of repeated use, and whose performance reduction is slight even if its surface is worn to an extent.

SUMMARY OF THE INVENTION

The present invention provides a golf ball having a plurality of dimples on a spherical surface thereof, the dimples each having a circular shape in a plan view, wherein a virtual dimple is supposed to have a circular shape having the same diameter as the circular shape of the dimple in the plan view, and to be a part of a circle having the same sectional area as that of the dimple in the sectional view;

at least 80% of the dimples have depths not less than 104% of the depth of the virtual dimple, and have a non-circular-arc-shape in a sectional view; and a total volume of the dimple is in a range of from 300 to 550 $mm^3$.

Since the depth of the dimple is deeply formed for sectional area thereof and the total volume is designed to fall within the above-mentioned numerical range, a necessary function of the dimple can be maintained even if the surface of the ball wears somewhat because of repeated shots as a practice ball. Therefore, it is possible to advantageously prevent a reduction in flight distance and the steep rise in trajectory that are caused by a reduction in dimple depth or a reduction in dimple volume.

In the present invention, the above-mentioned depth of the dimple is at least 4% deeper, preferably in a range of from 8 to 30% deeper, than that of the virtual dimple.

In addition, preferably, the dimple is formed by joining a plurality of different shapes with each other, and the joining portion is positioned at a position of 50% to 90% to the dimple depth.

Preferably, the percentage of the area of all dimples in the entire spherical surface of the ball is 73% or less. If the total area of the dimples is designed to be low like this, it is possible to advantageously prevent the destruction of undimpled portions that is liable to occur because of repeated shots.

As for the structure of the golf ball, the whole thereof can be made of a single kind of elastic material such as rubber (called a one-piece ball). If so made, it is preferable for the ball to have such hardness so as to be deformed by 2.2 to 3.8 mm when a load of 981N (100 Kgf) is applied to the ball placed on a flat plate.

The golf ball can also be made of a composite material structure (i.e., multi-piece solid) in which, for example, a rubber-made core, which has such hardness so as to be deformed by 2.8 to 4.0 mm when a load of 981N (100 Kgf) is applied to the core placed on the flat plate, is disposed at the center of the ball, and the core is covered with a resin cover whose Shore D hardness is 43 to 59. In a usually known ball that is made of a hard core and a cover which is low in hardness, the cover material between a hard club face and the hard core often has its surface shaved off early because of repeated shots. However, if the core and the cover are made such that, as shown in the above-mentioned numerical range, the relatively low-hardness cover material is combined with the largely deformable core, the early destruction of the cover can be prevented effectively.

BREIF DESCRIPTION OF THE DRAWINGS

DETAILED DESCRIPTION OF THE PREFERRED EMBODIMENT

An embodiment according to the present invention will be described in detail hereinafter with reference to the attached drawings.

Figure 1:
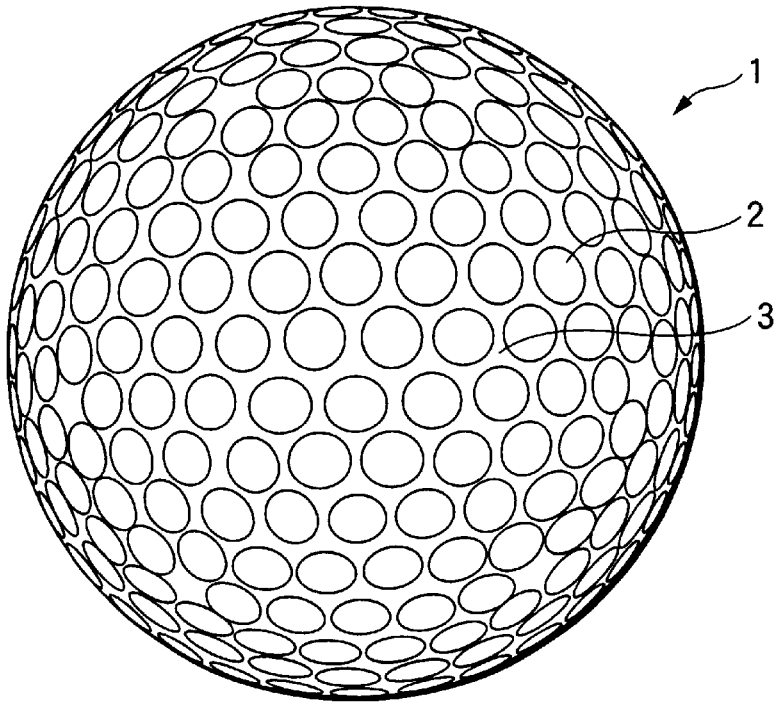
FIG. 1 is a plan view of a golf ball showing an example of the arrangement of dimples.
Figure 2:
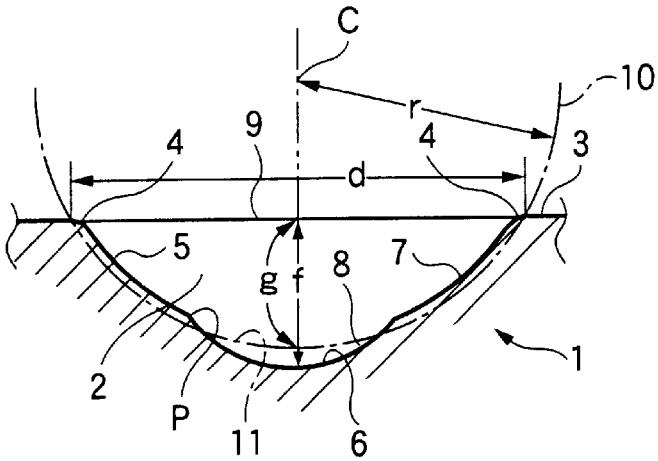
FIG. 2 is a sectional view showing an example of a dimple part in the present invention.

FIG. 1 is a plan view of a golf ball that shows an example of the arrangement of dimples, and FIG. 2 is an enlarged sectional view that shows an example of a dimple part in the present invention.

The golf ball 1 of the present invention is characterized in that the golf ball 1 has a large number of substantially circular dimples 2, when viewed frontally, on its spherical surface, and at least 80% of all the dimples 2 are dimples each of which is a circle, when viewed frontally, having a diameter d and each of which is a non-circular-arc section, when viewed sectionally, and has a depth of 4% or more deeper than a depth g of a virtual dimple assuming a part 11 of a perfect circle 10 with a sectional area equal to that of the dimple 2, and the total volume of the dimples 2 is 300 to 550 $mm^3$.

Incidentally, in the present invention, the structure, contours, etc., of the dimples mean those of the dimples of an end-product. Therefore, if a ball as an end-product undergoes paint coating, the structure and contours of a dimple of the ball that has undergone paint coating are those of the present invention. If a ball does not undergo paint coating, the structure and contours of a dimple of the ball that has no paint coating are, of course, those of the present invention.

A feature of the dimple 2 shown in FIG. 2 is that a first wall part 7 and a second wall part 8, which are different from each other in the contours, are joined at a position P, and whereby a wall surface 5 forms a non-circular-arc shape.

Base points indicating the diameter d of the dimple, i.e., dimple edges 4 are each positioned at an upper terminal of the dimple 2, and the dimple 2 connect to an undimpled portion or land portion 3 at the edges 4. The depth of the dimple, from the center of a straight line (or a circular plane) 9 connecting both edges 4 and 4 to a bottom 6, is denoted by reference character f.

On the other hand, apart of a circle 10 (this is a perfect circle, but its upper half is omitted in FIG. 2) passing through both edges 4, 4, that is indicated by a dashed line 11 in FIG. 2, has a circular plane 9 that has the same diameter d as the dimple 2, and a hollow part under the plane 9 denotes a virtual dimple that has a depth g from the center of the plane 9 to the bottom of the circular arc 11. In the section shown in FIG. 2, a cross sectional area surrounded with the virtual dimple and the line 9 is equal to an area surrounded with the dimple 2 and the line 9. The depth f of the dimple 2 is not less than 104% of the depth g of the virtual dimple, preferably in a range of from 108 to 130% of the depth g of the virtual dimple.

In the example of the dimple shown in FIG. 2, the first wall part 7 of the wall surface 5 includes a circular-arc concave surface having a relatively large radius of curvature and an upper end part of a convex surface that is reversed a little in the opposite direction, and the first wall part 7 connects to the undimpled portion 3 at the position of the edge 4 that is the top end of the upper end part. The second wall part 8 of the wall surface 5 is formed by a circular-arc concave surface that has a smaller radius of curvature. The joining portion P of the first and second wall parts 7, 8 of the wall surface 5 is arranged at a position where a depth from the plane 9 is equal to or deeper than 50% of the depth f of the dimple 2, preferably a position where a depth from the plane 9 is in a range from 50 to 90% of the depth f of the dimple 2.

Incidentally, if the dimple 2 is formed by composite contours including different curved surfaces, the above-mentioned circular-arc contours do not necessarily need to be applied. However, the curved surface of the bottom side of the second wall part 8 can be greatly hollowed as compared to the curved surface of the edge side of the first wall part 7, according to circumstances, the bottom 6 can be acutely shaped.

The total number of the dimples 2 provided in the golf ball 1 (see FIG. 1) is 340 to 416, and the total volume thereof is 300 to 550 $mm^3$, preferably 350 to 480 $mm^3$.

Preferably, percentage of the total area of all the dimples (i.e., total of the areas of the plane 9) in the entire spherical surface of the ball 1 is 73% or less.

FIG. 1 shows one example of the ball having the dimples each of which has the same single circular shape when viewed frontally. However, the kind of the dimple is not limited to one kind. A plurality of kinds (two to five kinds) of dimples that are different from each other in a diameter d and/or in a depth f can be arranged evenly. In that case, the diameter d and the depth f are in a range of 2 to 5 mm and 0.1 to 0.3 mm, respectively.

Figure 3:
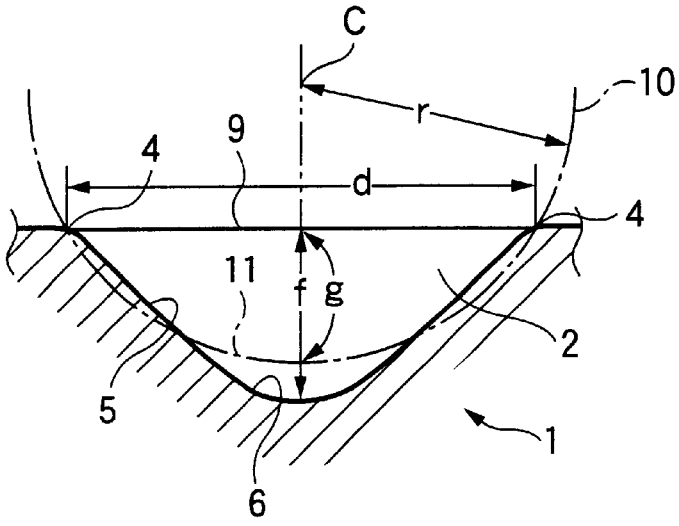
FIG. 3 is a sectional view showing another example of a dimple part in the present invention.
Figure 4:
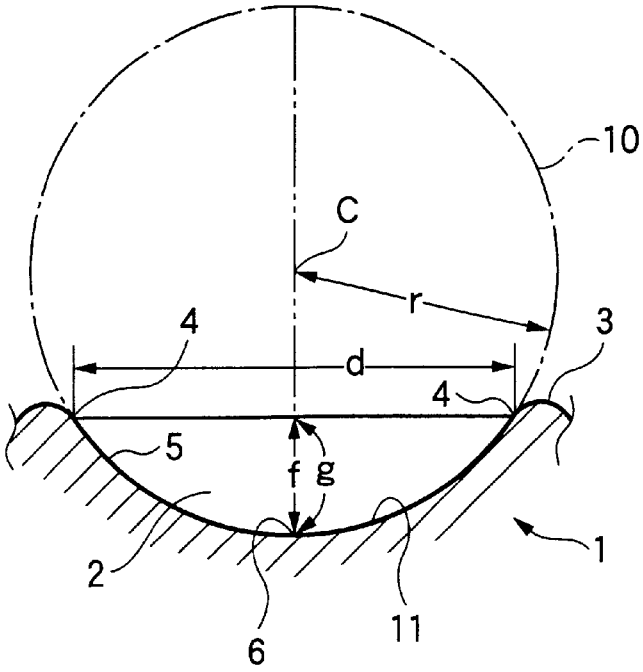
FIG. 4 is a sectional view of a dimple part of a conventional golf ball.
Figure 5:
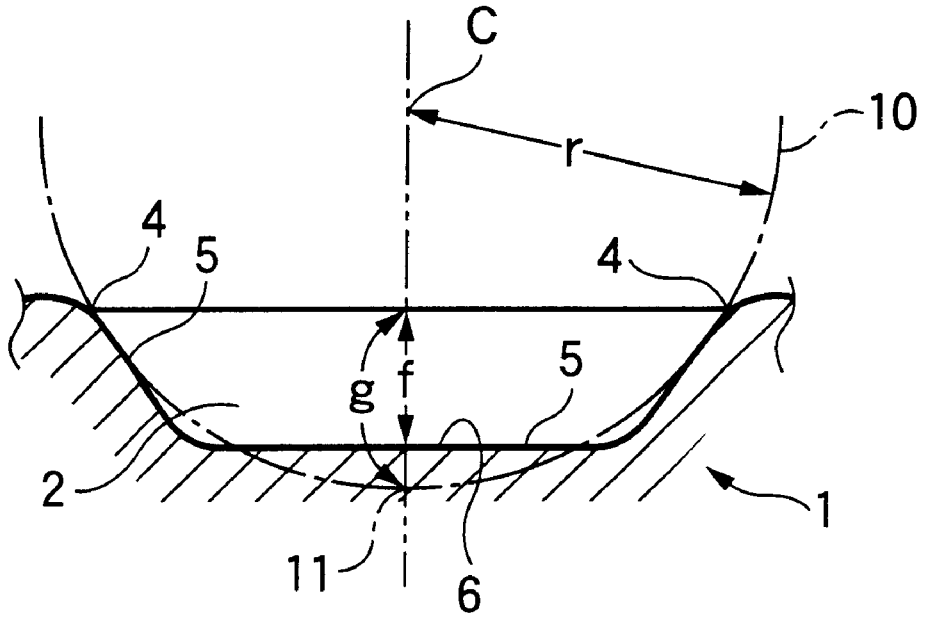
FIG. 5 is a sectional view of a dimple part of a conventional golf ball.

FIG. 3 is a sectional view that shows another example of a dimple.

A feature of this dimple 2 is that the right half section thereof exhibits roughly a shape of a letter "S". That is, the contour of the right half section thereof starts from the edge 4, and follows an upper part having a convex surface upwardly facing and, via an intermediate part extending almost straight, reaches the bottom 6 having a concave surface toward the inward of the golf ball. The left half thereof is symmetric with respect to a chain double-dashed line, and the bottom 6 as a whole is formed to be nearly tapered toward the center of the ball.

Also in the example shown in FIG. 3, an sectional area surrounded with the dimple 2 and the line 9 is equal to an sectional area surrounded with a virtual dimple and the line 9. The depth f of the dimple 2 is not less than 104% of the depth g of the virtual dimple.

In the present invention, the golf ball is 43 to 46 g in weight, and 42.0 to 43.0 mm in diameter.

A compound example of materials of a one-piece ball is shown as follows:

| | |
|---|---|
| cis-1,4-polybutadiene | 100 parts by weight |
| methacrylic acid | 22 parts by weight |
| zinc oxide | 23 parts by weight |
| dicumyl peroxide | 1 parts by weight |

These, as base materials, are kneaded by a kneading roll, and are subjected to heat pressure molding for 25 minutes at 175° C. to obtain a one-piece ball.

Next, a compound example of materials of a core part of a two-piece ball is shown as follows:

| | |
|---|---|
| cis-1,4-polybutadiene | 100 parts by weight |
| zinc acrylate | 20 parts by weight |
| zinc oxide | 23 parts by weight |
| dicumyl peroxide | 1 parts by weight |

These, as base materials, are kneaded by the kneading roll, and are subjected to heat pressure molding for 20 minutes at 160° C. to obtain a solid core.

Subsequently, the core is coated with a covering material (e.g., a resin cover) according to a normal method, and a two-piece ball is obtained.

The performance of the above-mentioned golf balls of the present invention was confirmed under the following conditions:

Embodiment 1: a one-piece ball having a sectional shape of dimples shown in FIG. 2, Comparative Example 1: a one-piece ball having a sectional shape of dimples shown in FIG. 2 (note that the dimple depth ratio $(f-g)/g\times100$ is smaller than that of embodiment 1), Embodiment 2: a two-piece ball solid having the same sectional shape of dimples as the embodiment 1, and Comparative Example 2: a two-piece ball solid having the virtual dimple in a sectional shape, as shown in FIG. 2 (indicated by the dashed line).

The dimple arrangement of FIG. 1 and the compound materials mentioned above were commonly applied to these embodiments and comparative examples.

In all balls to be tested, the dimple diameter d is 3.7 mm, the total number of the dimples is 360, and the percentage of the total area of the dimples to the surface area of the ball is 67.67%. In each ball of the embodiments and the comparative examples, flight performance thereof in brand-new condition and the flight performance thereof that had been used for a given period of time were measured. The measurement results are shown in Table 1 together with the details of the dimple structure.

TABLE 1

| | Embodiment 1 | Embodiment 2 | Comparative example. 1 | Comparative example. 2 |
|---|---|---|---|---|
| (f-g)/g × 100 (%) | 8 | 10 | 1 | 0 |
| total dimple volume ($mm^3$) | 390 | 420 | 390 | 420 |
| carry (in bradnd-new condition, m) | 196 | 190 | 195 | 191 |
| elevation angle (in brand-new condition, °) | 10 | 9.6 | 9.9 | 9.6 |
| carry (after use, m) | 193 | 186 | 186 | 180 |
| elevation angle (after use, °) | 10.3 | 9.8 | 11.0 | 10.9 |

The after use for a given period of time means that the golf balls of the embodiments and the comparative examples were provided to a driving range, and the balls were used for six months there, and were collected again. Five balls for each of the embodiments and comparative examples were selected from among the ones collected as balls to be tested, and the flight performance of them was measured. Table 1 shows average values of the measurement results. One ball in brand-new condition was given as a ball to be tested to each of the embodiments and comparative examples.

In order to measure the flight performance, a swing robot and a #1 wood were used under condition of a head speed of 45 m/s.

As shown in Table 1, in the golf ball according to the invention, especially as a practice golf ball, a reduction in the dimple depth and/or a reduction in the total dimple volume that occur after repeated shots do not directly influence on the flight performance of the ball. Therefore, the initial performance of the ball can be advantageously maintained for a long time.

What is claimed is:

1. A golf ball formed of a rubber-made solid core and a resin cover enclosing the solid core and having a diameter of 42.0 to 43.0 mm wherein a cover surface of the golf ball has a plurality of dimples on a spherical surface thereof, the dimples each having a circular shape in a plan view, wherein a virtual dimple having a circular shape having the same diameter as the circular shape of the dimple in the plan view, and wherein said virtual dimple has the same sectional area as that of the dimple in the sectional view;

at least 80% of the dimples have depths nor less than 104% of the depth of the virtual dimple, and have a non-circular-arc-shape in a sectional view;

the total number of the dimples is 340 to 416;

a total volume of the dimples is in a range of 300 to 550 $mm^3$;

the cover has a Shore D hardness of 43 to 59;

wherein the dimple is formed by joining a plurality of kinds of concave surfaces;

wherein a joining portion between the concave surfaces is arranged at a position which corresponds to a depth in a range of 50 to 90% of the depth of the dimple;

wherein the dimple has a first wall part having a relatively large radius of curvature connected to a land portion of the ball and a second wall part having a smaller radius curvature connected to the first wall part at the joining portion; and wherein the first wall part has at the position adjacent to the land portion a convex surface that is reversed in the opposite direction.

2. The golf ball according to claim 1, wherein the core has such hardness as to be deformed by 2.8 to 4.0 mm when a load of 981N (100 Kgf) is applied to the core placed on a flat plate.

3. The golf ball according to claim 1, wherein a percentage of an area of all the dimples in thc whole spherical surface of the golf ball is Less than 73%.

4. The golf ball according to claim 3, wherein the core has such hardness as to be deformed by 2.8 to 4.0 mm when a load of 981N (100 Kgf) is applied to the core placed on a flat plate.

5. A golf ball of claim 1, wherein the ball has such hardness as to be deformed by 2.2 to 3.8 mm when a load of 981 N (100 kgf) is applied to the ball placed on a flat plate;

wherein a percentage of an area of all the dimples in the whole spherical surface of the golf ball is less than 73%; and wherein the dimples have depths of 108 to 130% of the depth of the virtual dimple.

* * * * *